US005984338A

United States Patent [19]

Meyer

[11] Patent Number: 5,984,338

[45] Date of Patent: Nov. 16, 1999

[54] LIGHTWEIGHT STABILIZED RAISING CHAIR

[75] Inventor: Bruno Meyer, Wohlen, Switzerland

[73] Assignee: Levo AG Dottikon, Dottikon, Switzerland

[21] Appl. No.: 08/882,684

[22] Filed: Jun. 25, 1997

[30] Foreign Application Priority Data

Jun. 27, 1996 [CH] Switzerland ..... 1612/96

[51] Int. Cl.[6] ..... A61G 5/00

[52] U.S. Cl. ..... 280/304.1; 297/316; 297/423.38; 297/DIG. 10

[58] Field of Search ..... 280/250.1, 304.1, 280/647, 650, 657, 642, 652; 297/DIG. 10, DIG. 4, 326, 423.25, 423.38; 180/65.1, 65.5, 907

[56] References Cited

U.S. PATENT DOCUMENTS

| | | | |
|---|---|---|---|
| 4,067,249 | 1/1978 | Deucher . | |
| 4,076,304 | 2/1978 | Deucher . | |
| 4,462,604 | 7/1984 | Meyer | 280/250.1 |
| 4,519,649 | 5/1985 | Tanaka et al. | 297/DIG. 4 |
| 4,592,570 | 6/1986 | Nassiri | 280/650 |
| 4,679,816 | 7/1987 | Riikonen | 280/650 |
| 5,328,247 | 7/1994 | Lovins . | |
| 5,356,172 | 10/1994 | Levy et al. | 280/250.1 |

FOREIGN PATENT DOCUMENTS

| | | |
|---|---|---|
| 0 065 129 A2 | 11/1982 | European Pat. Off. . |
| 0 159 562 A2 | 10/1985 | European Pat. Off. . |
| 0 463 652 A1 | 1/1992 | European Pat. Off. . |
| 2 697 418 | 5/1994 | France . |
| WO 79/00647 | 9/1979 | WIPO . |

*Primary Examiner*—Anne Marie Boehler
*Attorney, Agent, or Firm*—Frishauf, Holtz, Goodman, Langer & Chick, P.C.

[57] ABSTRACT

The raising wheelchair, for stability, has a wheeled frame, preferably including two side frames (25), and a raising system (21) with the customary seat and backrest, pivotably secured to the wheeled frame (11). A footrest (23) is connected to at least one shaft or rod element (37) which is guided in a tubular element of the respective side frame (25). Coupling elements (39) at each side of the wheelchair couple the raising system (21) with the shaft or rod element (37) of the footrest (23). Light weight and high stability are obtained by utilizing a portion of the frame construction for guidance of the footrest in its movement from a raised to a lowered position against a floor.

14 Claims, 3 Drawing Sheets

LIGHTWEIGHT STABILIZED RAISING CHAIR

Reference to related patents, the disclosures of which are hereby incorporated by reference:

U.S. Pat. No. 4,076,304, Deucher;

U.S. Pat. No. 4,067,249, Deucher;

U.S. Pat. No. 4,598,944, Meyer, the inventor hereof, first published as European 0 159 562A2;

U.S. Pat. No. 4,462,604, Meyer, the inventor hereof, first published as European 0 065 129A2;

U.S. Pat. No. 5,328,247, Lovins.

Reference to related patent literature:

Int. Publ. WO 79/00647, Rasmussen;

European 0 463 652A1, Beumer;

French 2 697 418, Konior et al.

FIELD OF THE INVENTION

The present invention relates to a raising wheelchair, and more particularly to such a wheelchair which has a wheeled frame and a raising system which includes a seat and the backrest. The raising system is pivotably coupled to the frame. A footrest is provided. When the raising system raises the seat and backrest to an upright position, the footrest is lowered to the ground to provide a stable support for a user.

U.S. Pat. No. 4,462,604, by the inventor hereof, to which European 0 065 129A2 corresponds, describes a raising wheelchair having a wheeled frame with two main wheels and two guidable or steerable wheels. A powered raising system can be moved by a drive mechanism about a pivotable axis on the frame. The raising system is formed with a seat and the backrest. The footrests are so pivotably coupled to the seat that they fit against the floor on which the wheelchair is located when the raising system raises the seat and the backrest. An electric motor is provided to raise and lower the raising system. U.S. Pat. No. 4,076,304 also shows an electronic motor operated raising wheelchair.

A somewhat similar wheelchair is described in U.S. Pat. No. 4,598,944, by the inventor hereof, to which European 0 159 562 corresponds, which, however, does not have an electric motor. A gas spring is provided which applies a force on the raising system to counteract the weight of the user, and thus supports the raising movement of the user. Handholds are provided to permit the user to raise herself/himself. Upon raising, the user applies a force on the handholds in order to decrease the weight acting on the seat. A blocking device is provided to block the position of the seat, in raised, or seating position, respectively. This raising wheelchair does not have a motor and, consequently, no batteries or power supply for the motor. Thus, it is substantially lighter than the raising wheelchair of the aforedescribed U.S. Pat. No. 4,462,604, European 0 065 129A.

Substantial efforts have been made in the last few years to further decrease the weight of raising-type chairs. This was first, and foremost achieved by substituting aluminum tube construction for previously used steel tubular construction. In part, the decreased weight, however, resulted in decreased stability of the overall wheelchair. Some users even had objected to the low degree of stability of the footrests, with raising chairs of steel tube construction. In the chairs according to the patents described above, the footrests are coupled to a shaft or rod element which is pivoted to the raising system, roughly at the knee level of the user. Somewhat therebelow, a coupling element pivotably couples the footrests with the wheeled frame. The footrests have, then, decreased stability and small forces are sufficient to cause a lateral pivotable movement. While not dangerous, such movement may disconcert users. A raising wheelchair in accordance with Int. Publ. WO 79/00647, Rasmussen, has similar disadvantages. In this wheelchair, the upper portion of a two-part footrest is pivotably coupled to the wheeled frame, roughly at knee level of the user and somewhat therebelow, a telescopically shiftable portion is coupled via a connection element with the raising system.

French Patent 2 697 418A2 describes a two-part footrest which is pivotably coupled with the seat. The seat, in turn, is pivotably coupled to a support which is, in turn, pivoted to the wheeled frame. Three pivot points, thus, are provided between the footrest and the frame, which is detrimental to stability.

THE INVENTION

It is an object to provide a raising-type wheelchair which has high stability, and still is of light weight. Additionally, it should be aesthetically pleasing in that lever mechanisms and the like should be located relatively hidden beneath the seat of the wheelchair.

Briefly, stability, with light weight is obtained by providing the footrest with at least one shaft or rod element which is guided in the wheeled frame, and a coupling element is provided to pivotably couple the shaft or rod element of the footrest with the raising system.

The footrest, in contrast to the prior art, is thus guided in the wheeled frame itself, and has substantially higher stability than pivotably located footrests. There are no pivot links between the wheeled frame and the footrest which might interfere with stability. A swinging movement to and fro, or oscillations, previously found so disconcerting by users, are effectively avoided.

Preferably, a telescopic guiding arrangement is provided for the shaft or rod element of the footrest; for example, the shaft or rod element may be telescopically guided within a tubular element of the wheeled frame itself, and the tubular element, as an integral portion of the wheeled frame, forms the stationary part of a two-part footrest. Highly stable guidance of the footrest is thus obtained in a simple and effective manner.

Each one of the feet of the user may be provided with a separate footrest element. Preferably, a common footrest to support both feet of the user is provided and, both sides have the shaft or rod element; the wheeled frame in turn, has a tubular element at each side thereof to guide the respective rod or shaft element. Double-sided guiding of a single footrest results in particularly high stability.

The raising system, preferably, may be formed, at both sides, with a two-armed lever, the shorter arm of which is pivoted to the corresponding coupling element. This results in a simple construction. A preferred embodiment provides for the tubular element, which serves as a guide for the shaft or rod element of the footrest, to have a slit in the upper portion thereof to provide guidance for a lateral projection extending from the shaft or rod element. The coupling element can be pivoted to this projection. In this construction, the coupling element is closely below the seat and, when the wheelchair is occupied by a user, becomes practically invisible. The raising wheelchair, thus, does not leave an excessively technologically complex impression with a viewer. It is, of course, also possible to connecting the coupling element further below, where the shaft or rod element extends from the tubular guide of the wheeled frame.

DRAWINGS

DETAILED DESCRIPTION

Figure 1:
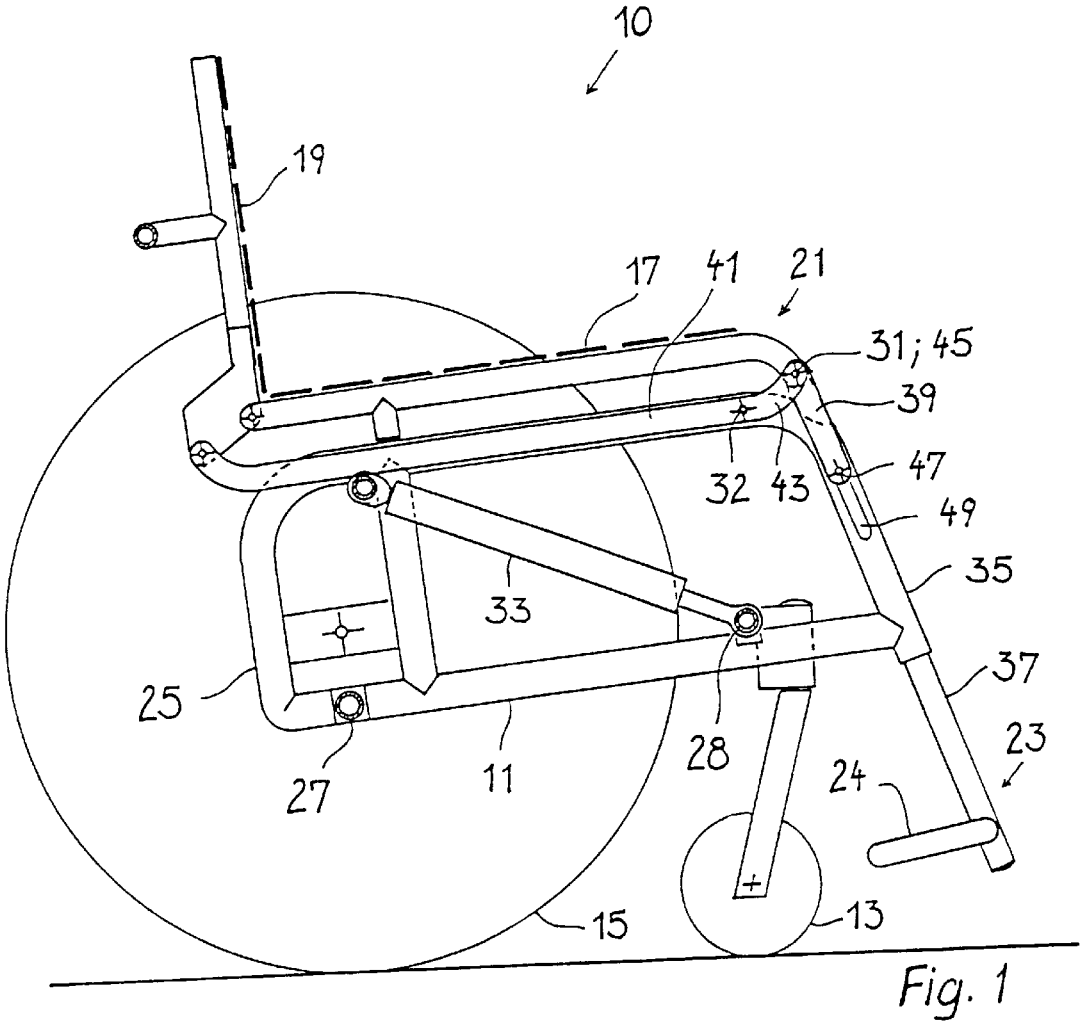
FIG. 1 is a highly schematic sideview of a wheelchair incorporating the present invention, when the wheelchair is in seating position.

The raising-type wheelchair 10 has, as is customary, a wheeled frame 11 with a pair of front wheels 13 and a pair of main or rear wheels 15. A raising system 21 is provided, which includes a seat 17 and a backrest 19. The wheelchair has a footrest 23, with a foot support surface 24.

The wheeled frame 11 is a tubular construction formed by two side frames 25, coupled together by cross-rods 27, 28. The wheeled frame 11, thus, forms a stable structure. The raising system 21 is pivoted to the wheeled frame 11 at a pivot point 32. The raising system 21 supports the seat 17 and the backrest 19 and, as well known, is so constructed that the backrest 19 has effectively the same, or approximately vertical position regardless of the position of the seat 17, that is, the position in which the raising system is at any time.

Figure 2:
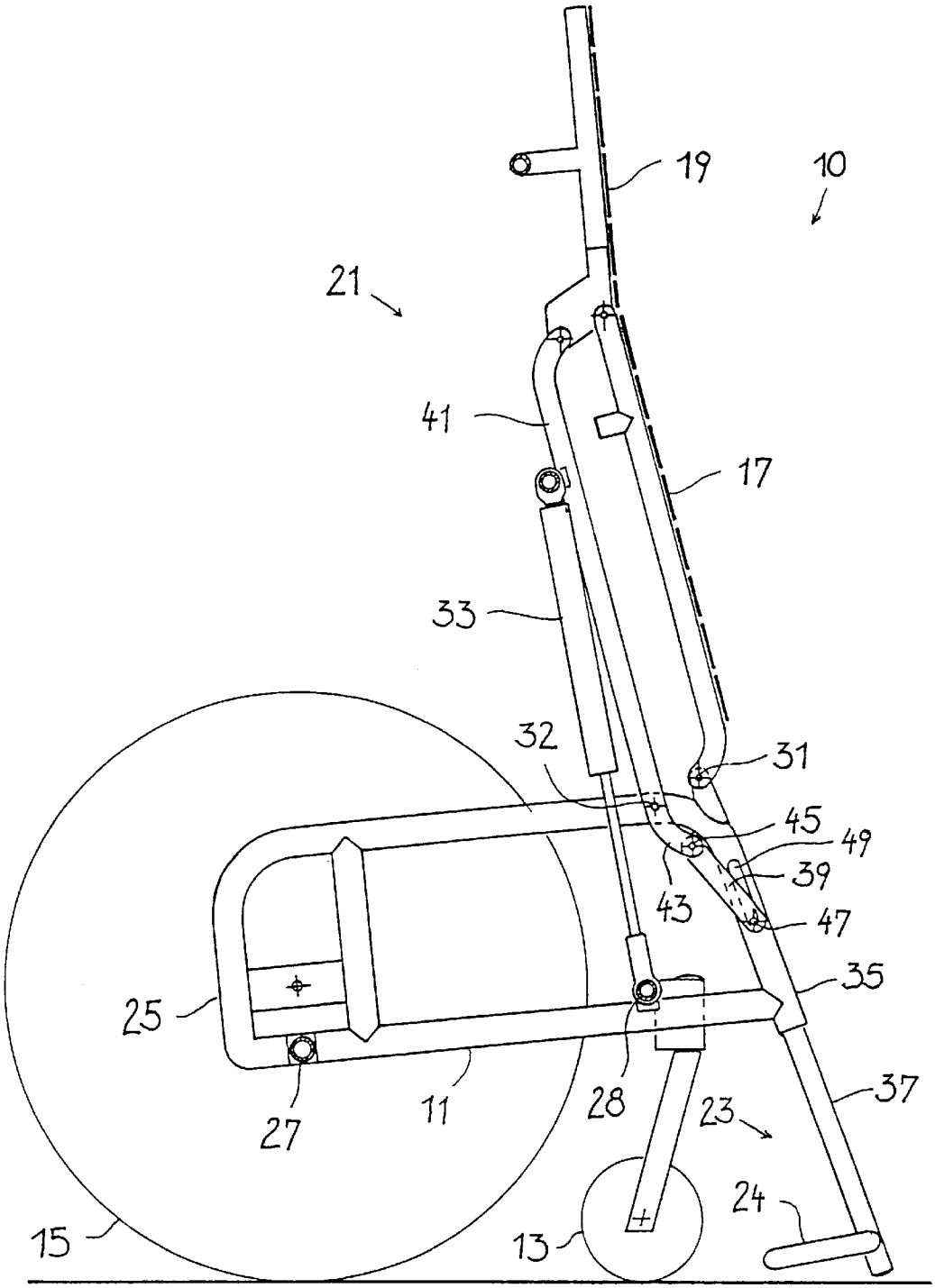
FIG. 2 is a view similar to FIG. 1, with the wheelchair in raised position.
Figure 3:
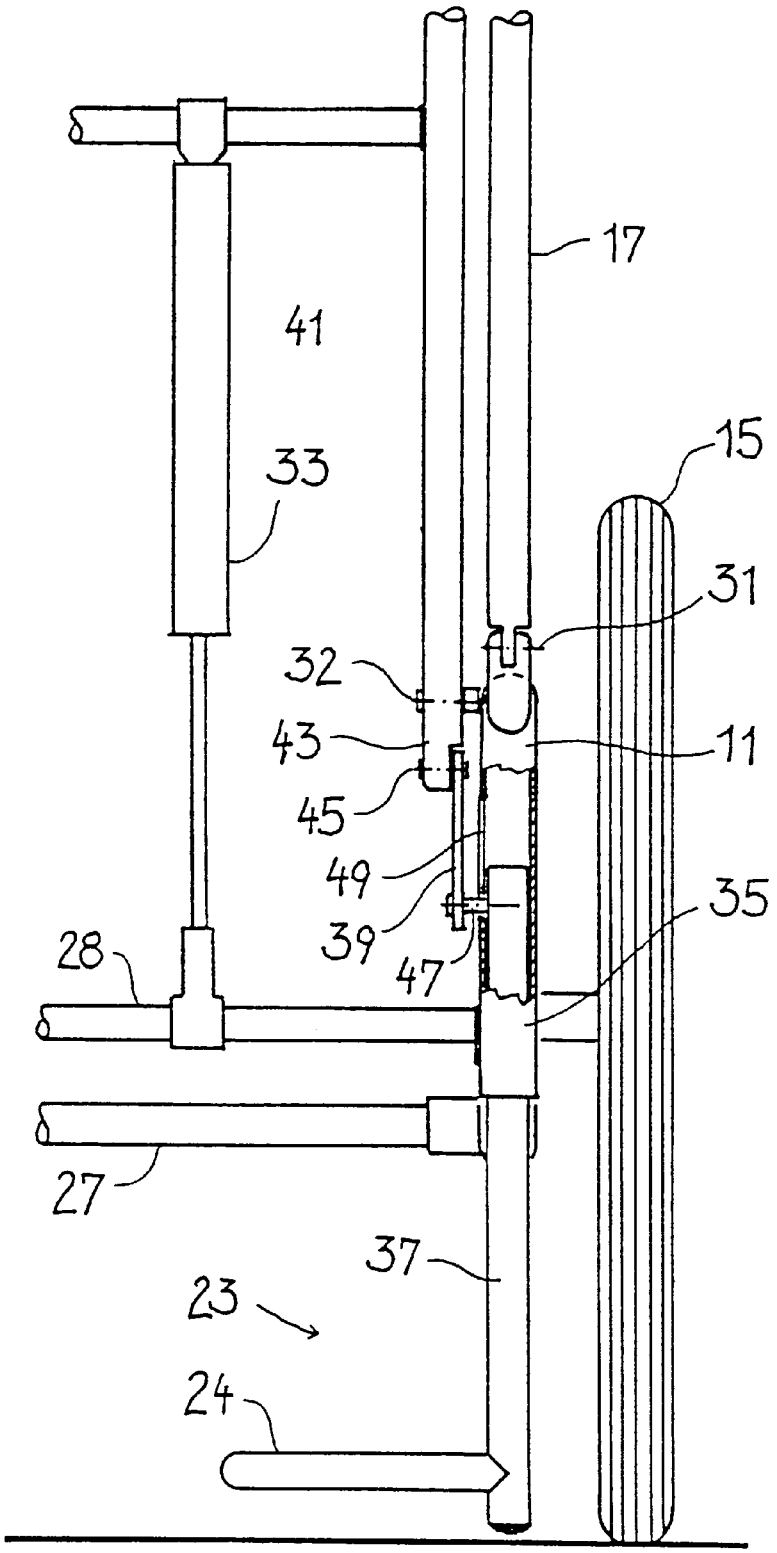
FIG. 3 is a fragmentary front view showing a detail of the mechanism which lowers the footrest.

Raising of the chair from the position shown in FIG. 1 to the position shown in FIG. 2 is supported in part by at least one gas spring 33. Control elements to release and block the gas spring have been omitted from the drawings for simplicity, since they may be of any suitable standard construction. Handholds for the user, which permit the user to raise herself/himself, likewise, have been omitted from the drawings, since they are not material to the present invention.

In accordance with a feature of the invention, the wheeled frame 11 has, at both sides, a tubular element or tube or pipe 35. A shaft or rod element 37 of the footrest 23 is telescopically received within the tube 35. The tube 35 can be a portion of the frame construction of the side frame 25. It is not necessary to provide for tubular guidance, since other guided systems can be used, for example, a connected dove-tail type guide. The raising system 21 is pivotably connected by a coupling element 39 with the shaft or rod element 37 of the footrest in such a manner that, upon raising movement of the chair, the footrest 23 is moved downwardly. A double-armed lever 41 has a shorter arm 43, which is pivoted to the coupling element 39 at a pivot point 45. The double-armed lever 41 is part of the raising system 21. The coupling element 39 is, in turn, pivotably connected over a pivot point 47 to the shaft or rod element 37. A pin or bolt is suitable for the pivot 47. The pivot 47 extends through a slit 49 in the upper portion of the tubular element 35.

OPERATION

Upon changing from the position of FIG. 1 into the position of FIG. 2, the lever arm 43 of lever 41 pivots downwardly, so that the footrest 23 is moved downwardly via the coupling element 39, pivot 47 and shaft or rod element 37, until the footrest engages a support surface, or the floor. Reversely, upon movement from raised position (FIG. 2) into the seating position (FIG. 1), the footrest 23 is moved upwardly, as can be clearly seen in FIG. 1.

This mechanism has no elements which project beyond the seat 17 which may interfere with a forward or lateral transfer of the user, which may be necessary, for example, to shift to a toilet seat.

Various changes and modifications may be made within the scope of the inventive concept.

I claim:

1. A raising wheelchair comprising:

a wheeled frame (11);

a raising system (21) including a seat (17) and a backrest (19), the raising system being pivotably secured to the wheeled frame;

a footrest (23) coupled to the raising system (21), said footrest being lowered and raised upon a change in position of the raising system between a seating and an upright position;

at least one shaft or rod element (37) coupled to the footrest (23), wherein movement of said shaft or rod element is translationally guided by the frame (11); and a coupling element (39) coupling the raising system (21) with the shaft or rod element (37) of the footrest (23).

2. The wheelchair of claim 1, wherein the frame (11) comprises a tubular element (35) and said shaft or rod element (37) of the footrest (23) is telescopically received and guided within said tubular element (35).

3. The wheelchair of claim 1, wherein the footrest (23) is elongated and dimensioned to receive both feet of a user of the wheelchair; and wherein two shaft or rod elements (37) are provided coupled to the footrest (23) at respective sides thereof, and each being guided on said frame (11).

4. The wheelchair of claim 1, wherein the frame (11) comprises two tubular elements (35) and two shaft or rod elements (37) of the footrest (23) being telescopically received and guided within a respective tubular element (35);

wherein the footrest (23) is elongated and dimensioned to receive both legs of a user of the wheelchair; and wherein said two shaft or rod elements (37) are coupled to the footrest (23) at respective sides thereof, and each being telescopically received in said respective tubular element, which elements are located at respective sides of said frame (11).

5. The wheelchair of claim 3, wherein the raising system (21) includes a double-armed lever (41) at both respective sides thereof; and wherein said double-armed lever includes a shorter arm (43) which is pivotably coupled to the respective coupling element (39) at the respective side of the wheelchair.

6. The wheelchair of claim 4, wherein the raising system (21) includes a double-armed lever (41) positioned at both respective sides thereof; and wherein said double-armed lever includes a shorter arm (43) which is pivotably coupled to the respective coupling element (39) at the respective side of the wheelchair.

7. The wheelchair of claim 3, wherein the frame (11) comprises two tubular elements (35), each of said two tubular elements (35) guiding a respective shaft or rod element (37), each of said two tubular elements having a longitudinally extending slit (49), at least in the upper portion thereof;

and said at least one shaft or rod element (37) at each side, having a laterally extending projection (47) extending through the respective slit, the respective coupling element (39) being pivotably coupled to the respective projection.

8. The wheelchair of claim 1, wherein the wheeled frame includes two side frames (25), and two cross-elements (27, 28) interconnecting said side frames.

9. The wheelchair of claim 8, wherein said two side frames (25) each include a tubular element (35); and wherein two shaft or rod elements (37) are provided, coupled to the footrest (23) at respective sides of the wheelchair, and telescopically received and guided within the respective tubular element (35) of said two side frames.

10. A raising wheelchair comprising:

a wheeled frame (11);

a raising system (21) including a seat (17) and a backrest (19), the raising system being pivotably secured to the wheeled frame;

a footrest (23) coupled to the raising system (21), said footrest being lowered and raised upon a change in position of the raising system between a seating and an upright position;

at least one shaft or rod element (37) coupled to the footrest (23), wherein movement of said at least one shaft or rod element is guided by the frame (11); and a coupling element (39) coupling the raising system (21) with said at least one shaft or rod element (37) of the footrest (23), wherein the frame (11) comprises a tubular element (35) and said at least one shaft or rod element (37) of the footrest (23) is telescopically received and guided within said tubular element (35).

11. A raising wheelchair comprising:

a wheeled frame (11);

a raising system (21) including a seat (17) and a backrest (19), the raising system being pivotably secured to the wheeled frame;

a footrest (23) coupled to the raising system (21), said footrest being lowered and raised upon a change in position of the raising system between a seating and an upright position;

at least one shaft or rod element (37) coupled to the footrest (23), wherein movement of said at least one shaft or rod element is guided by the frame (11); and a coupling element (39) coupling the raising system (21) with said at least one shaft or rod element (37) of the footrest (23), wherein the frame (11) comprises two tubular elements (35) and two shaft or rod elements (37) of the footrest (23) being telescopically received and guided within a respective tubular element (35);

wherein the footrest (23) is elongated and dimensioned to receive both legs of a user of the wheelchair; and wherein said two shaft or rod elements (37) are coupled to the footrest (23) at respective sides thereof, and each being telescopically received in said respective tubular element, which elements are located at respective sides of said frame (11).

12. The wheelchair of claim 11, wherein the raising system (21) includes a double-armed lever (41) positioned at both respective sides thereof; and wherein said double-armed lever includes a shorter arm (43) which is pivotally coupled to the respective coupling element (39) at the respective side of the wheelchair.

13. A raising wheelchair comprising:

a wheeled frame (11);

a raising system (21) including a seat (17) and a backrest (19), pivotably secured to the wheeled frame;

a footrest (23) coupled to the raising system (21), said footrest being lowered and raised upon a change in position of the raising system between a seating and an upright position;

two shafts or rod elements (37) coupled to the footrest (23), wherein movement of said shafts or rod elements are guided by the frame (11); and a coupling element (39) coupling the raising system (21) with said shafts or rod elements (37) of the footrest (23);

wherein the footrest (23) is elongated and dimensioned to receive both feet of a user of the wheelchair;

wherein said two shafts or rod elements (37) are coupled to the footrest (23) at respective sides thereof, and each being guided on said frame (11);

wherein the frame (11) comprises two tubular elements (35), each of said two tubular elements (35) guiding a respective one of said shafts or rod elements (37), each of said two tubular elements having a longitudinally extending slit (49), at least in the upper portion thereof; and wherein each of said two shafts or rod elements (37) includes a laterally extending projection (47) extending through the respective slit, the respective coupling element (39) being pivotably coupled to the respective projection.

14. A raising wheelchair comprising:

a wheeled frame (11);

a raising system (21) including a seat (17) and a backrest (19), pivotably secured to the wheeled frame;

a footrest (23) coupled to the raising system (21), which footrest is movable to be lowered and raised upon a change in position of the raising system between a seating and an upright position;

two shafts or rod elements (37) coupled to the footrest (23), wherein movement of said shafts or rod elements is guided by the frame (11); and a coupling element (39) coupling the raising system (21) with said shafts or rod elements (37) of the footrest (23), wherein the wheeled frame includes two side frames (25), and two cross-elements (27, 28) interconnecting said side frames;

wherein said two side frames (25) each include a tubular element (35); and wherein said two shafts or rod elements (37) are coupled to the footrest (23) at respective sides of the wheelchair, and telescopically received and guided within the respective tubular element (35) of said two side frames.

* * * * *